US011076699B2

(12) United States Patent
Griepentrog

(10) Patent No.: US 11,076,699 B2
(45) Date of Patent: Aug. 3, 2021

(54) UNIVERSAL TABLET ARM FOR CHAIRS

(71) Applicant: Krueger International, Inc., Green Bay, WI (US)

(72) Inventor: Dennis Griepentrog, De Pere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 16/661,356

(22) Filed: Oct. 23, 2019

(65) Prior Publication Data

US 2021/0120961 A1 Apr. 29, 2021

(51) Int. Cl.
*A47C 7/70* (2006.01)
*A47B 83/02* (2006.01)

(52) U.S. Cl.
CPC ..... *A47C 7/70* (2013.01); *A47B 83/02* (2013.01)

(58) Field of Classification Search
CPC ..... A47C 7/70; A47B 83/02
See application file for complete search history.

(56) References Cited

U.S. PATENT DOCUMENTS 2,684,261 A 7/1954 Krohm
3,197,254 A 7/1965 Hendrickson
3,479,084 A 11/1969 Vanryn
3,547,488 A 12/1970 Barnes
5,087,096 A * 2/1992 Yamazaki ..... A47C 7/70 297/145
5,720,465 A 2/1998 Peltzer
6,073,997 A 6/2000 Koh
7,101,110 B2 9/2006 Lapointe
7,370,910 B2 5/2008 Piretti
7,695,061 B2 4/2010 Olarte
8,109,566 B2 2/2012 Koh
8,256,835 B2 9/2012 Brink et al.
8,746,788 B2 6/2014 Su
8,851,564 B2 * 10/2014 Seo ..... A47C 7/705 297/162
9,380,870 B2 7/2016 Babick
9,521,908 B1 12/2016 Beck et al.
9,693,625 B2 7/2017 Lu
(Continued)

FOREIGN PATENT DOCUMENTS

EP 1266596 B1 5/2002
EP 2926694 A1 1/2015

*Primary Examiner* — David R Dunn
*Assistant Examiner* — Tania Abraham
(74) *Attorney, Agent, or Firm* — Andrus Intellectual Property Law, LLP

(57) ABSTRACT

A movable tablet for use with a chair is disclosed. The movable tablet is part of a mounting assembly that allows the tablet to be used with different types of chairs. The mounting assembly includes a stationary pivot rod and an outer housing that surrounds the pivot rod. A lower bearing is positioned between the outer housing and a mounting plate secured to a back face of the tablet. A guide hub of the lower bearing travels within a guide track on the mounting plate secured to the tablet to limit the pivoting movement of the tablet. An upper bearing is positioned between the mounting plate and the tablet such that the upper and lower bearings are positioned between metallic elements of the mounting assembly. A friction disc is positioned within the mounting assembly to control and adjust the pivoting movement of the tablet relative to the stationary pivot bar.

18 Claims, 9 Drawing Sheets

(56) References Cited

U.S. PATENT DOCUMENTS

| | | | | |
|---|---|---|---|---|
| 2006/0109257 | A1 | 5/2006 | Ambasz | |
| 2006/0238011 | A1 | 10/2006 | Bedford et al. | |
| 2007/0132283 | A1 | 6/2007 | Mitjans | |
| 2010/0282923 | A1 | 11/2010 | Wang et al. | |
| 2019/0090648 | A1* | 3/2019 | Su | A47C 7/70 |

* cited by examiner

FIG. 9
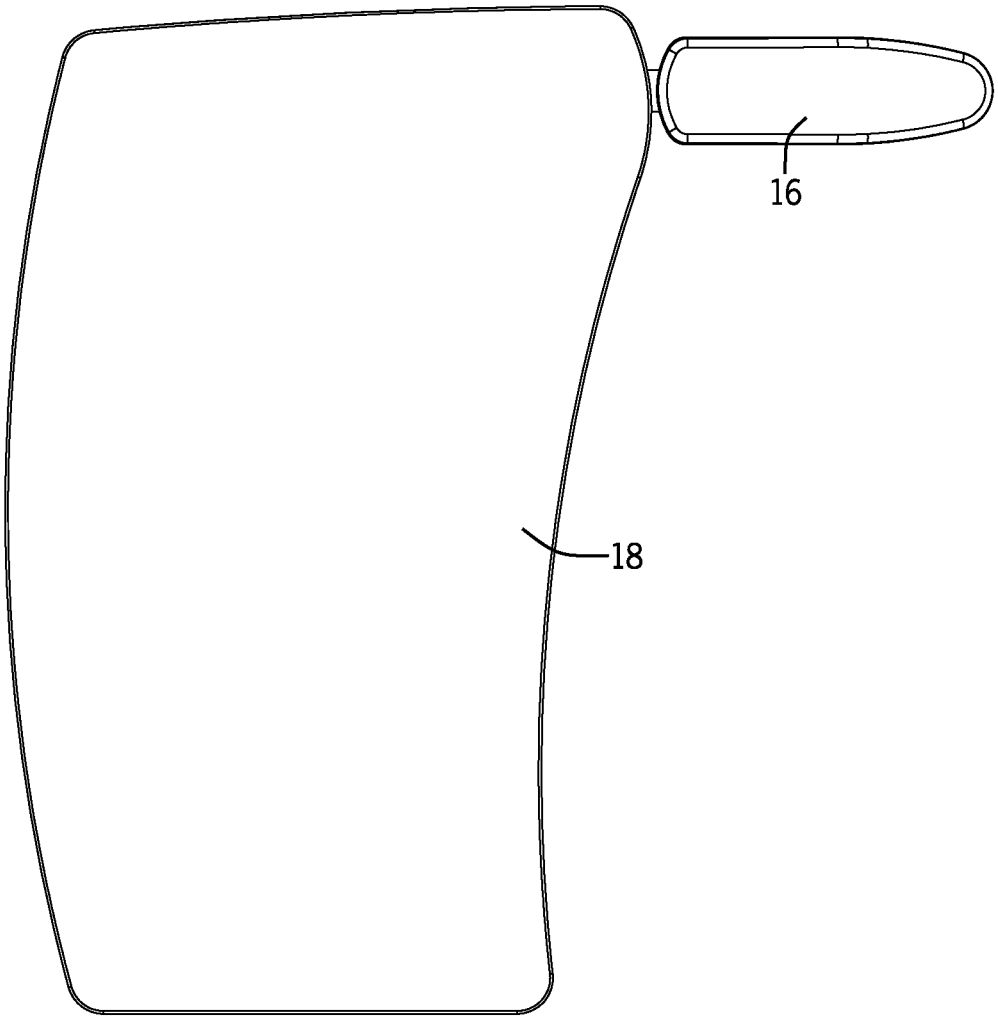
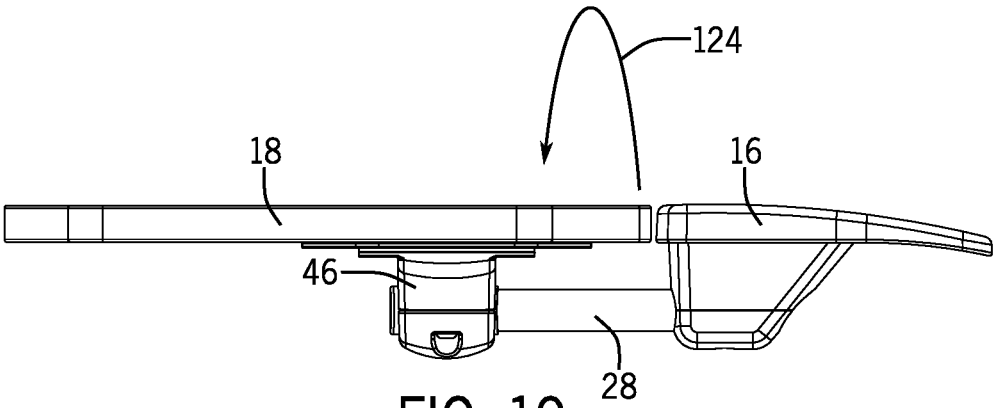
FIG. 10

UNIVERSAL TABLET ARM FOR CHAIRS

BACKGROUND

The present disclosure relates to chairs with a movable tablet arm. More specifically, the present disclosure relates to a chair with a tablet arm that encloses the moving components required to move the tablet between multiple positions.

Tablet arm chairs are often used in different seating applications in which the seat occupant needs a writing tablet to support documents or a computer. The tablet arm assembly is typically mounted to once side of the chair and includes a planar board or tablet that defines a writing surface. The tablet is mounted to a movable mounting arrangement that provides movement of the tablet relative to the chair between an operative position in which the tablet upper surface is substantially horizontal and a storage position in which the tablet is moved either under the seat or beside the seat and is in a generally vertical position. The movement of the tablet between the operative and storage positions includes two pivot axes that allow the tablet to pivot in multiple directions. A conventional fold-down tablet does not have adjustable friction setting devices that allows the rotation of the tablet to be controlled. The present disclosure is directed to a tablet arm that can be used with multiple different types of chairs and addresses various issues related with the use of the tablet.

SUMMARY

The present disclosure relates to chairs that include a movable tablet arm for use in supporting papers or a laptop by a seat occupant. More specifically, the present disclosure relates to a chair with a tablet arm that includes a housing that encloses the moving components required to move the tablet between multiple positions.

In an exemplary embodiment of the present disclosure, a tablet assembly is provided for use at a side of a chair. The tablet assembly includes a tablet that is rotatable about a first pivot axis and a second pivot axis such that the tablet is movable between a storage position and a use position. A horizontal pivot bar is configured to be securely attached to an arm of the chair to support the tablet. The horizontal pivot bar defines the first pivot axis for the tablet. A pivot limiting pin extends through an outer end of the pivot bar.

An outer housing surrounds the pivot bar and the pivot limiting pin. The outer housing includes first and second stop shoulders that engage the pivot limiting pin to define and limit the amount of pivoting movement of the tablet about the first pivot axis. The outer housing is formed from first and second mating castings that are joined to each other around the pivot bar. In one embodiment of the disclosure, an end cap formed from a plastic material surrounds the pivot bar and is located between the pivot bar and the outer housing.

A mounting plate is attached to a bottom face of the tablet and includes an arcuate guide track. The guide track is centered on the second pivot axis includes first and second stops that limit the amount of rotation of the tablet about the second pivot axis. The tablet assembly further includes a lower bearing that is positioned between the mounting plate and the outer housing. The lower bearing is formed from a plastic material to prevent metal-on-metal contact between the mounting plate and the outer housing. The lower bearing includes a guide hub that extends into the guide track. During pivoting movement of the tablet about the second pivot axis, the guide hub travels within the guide track. Contact between the guide hub and either the first or second stops of the guide track limit the pivoting movement of the tablet and thus define the amount of rotation possible.

In one exemplary embodiment of the present disclosure, an upper bearing is provided between the mounting plate and a clamp plate. The upper bearing is formed from a plastic material and receives the guide hub of the lower bearing to secure the guide hub within the guide track. In another exemplary embodiment, a friction disk is positioned to adjust the amount of friction present during rotation of the tablet. The friction disk is adjustable by a set screw to selectively increase or decrease the friction that opposes the movement of the tablet.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 9 is a top view of the chair arm and tablet in the use position;

FIG. 10 is a side view of the chair arm and tablet in the use position;

DETAILED DESCRIPTION

Figures 1, 2, 3:
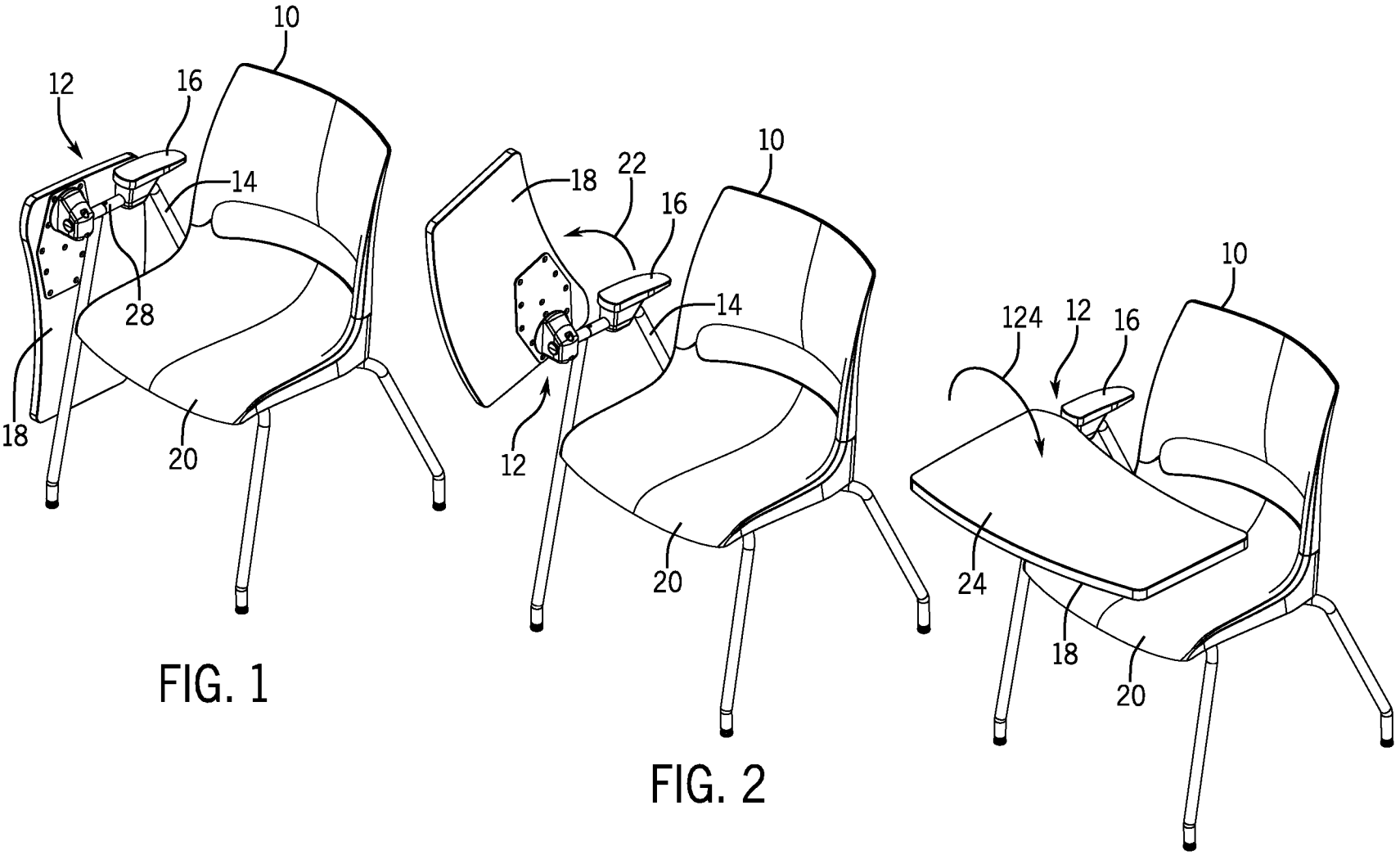
FIG. 1 is a perspective view illustrating a chair including a tablet in the storage position.
FIG. 2 is a perspective view of the chair including the tablet rotated into an intermediate position.
FIG. 3 is a perspective view of the chair with the tablet rotated into the use position.

FIGS. 1-3 illustrate a chair 10 that includes the tablet arm assembly 12 constructed in accordance with the present disclosure. The chair 10 includes a single arm 14 that includes an arm rest 16. In each of the embodiments shown in FIGS. 1-3, the arm 14 is mounted on the right side of the chair such that the tablet arm assembly 12 is designed for use by a right-handed writer. However, the chair arm, arm rest and tablet arm assembly could also be mounted to the left side of the chair such that the tablet arm assembly 12 could be used by a left-handed writer.

FIG. 1 illustrates the tablet arm assembly in the storage position in which the tablet 18 is generally vertical and positioned to the side of the seat 20 of the chair 10. FIG. 2 illustrates the tablet 18 in an intermediate position in which the tablet 18 has been rotated as illustrated by arrow 22 such that the tablet 18 is still positioned to the side of the seat 20 but has been rotated 180° to the vertically upright position shown in FIG. 2. FIG. 3 illustrates the tablet 18 in a horizontal, usage position in which the tablet 18 extends over the seat 20 such that the top surface 24 of the tablet 18 can be used by a seat occupant to support writing materials or a laptop. As can be understood in the views of FIGS. 1-3, the tablet 18 is rotatable about a first pivot axis and a second pivot axis that are normal to each other to permit the initial rotating movement from the storage position shown in FIG. 1 to the intermediate position shown in FIG. 2 and subsequent rotation from the intermediate position shown in FIG. 2 to the usage position shown in FIG. 3. To support such movement, the tablet arm assembly 12 includes rotational components which will be described in greater detail below.

Figure 4:
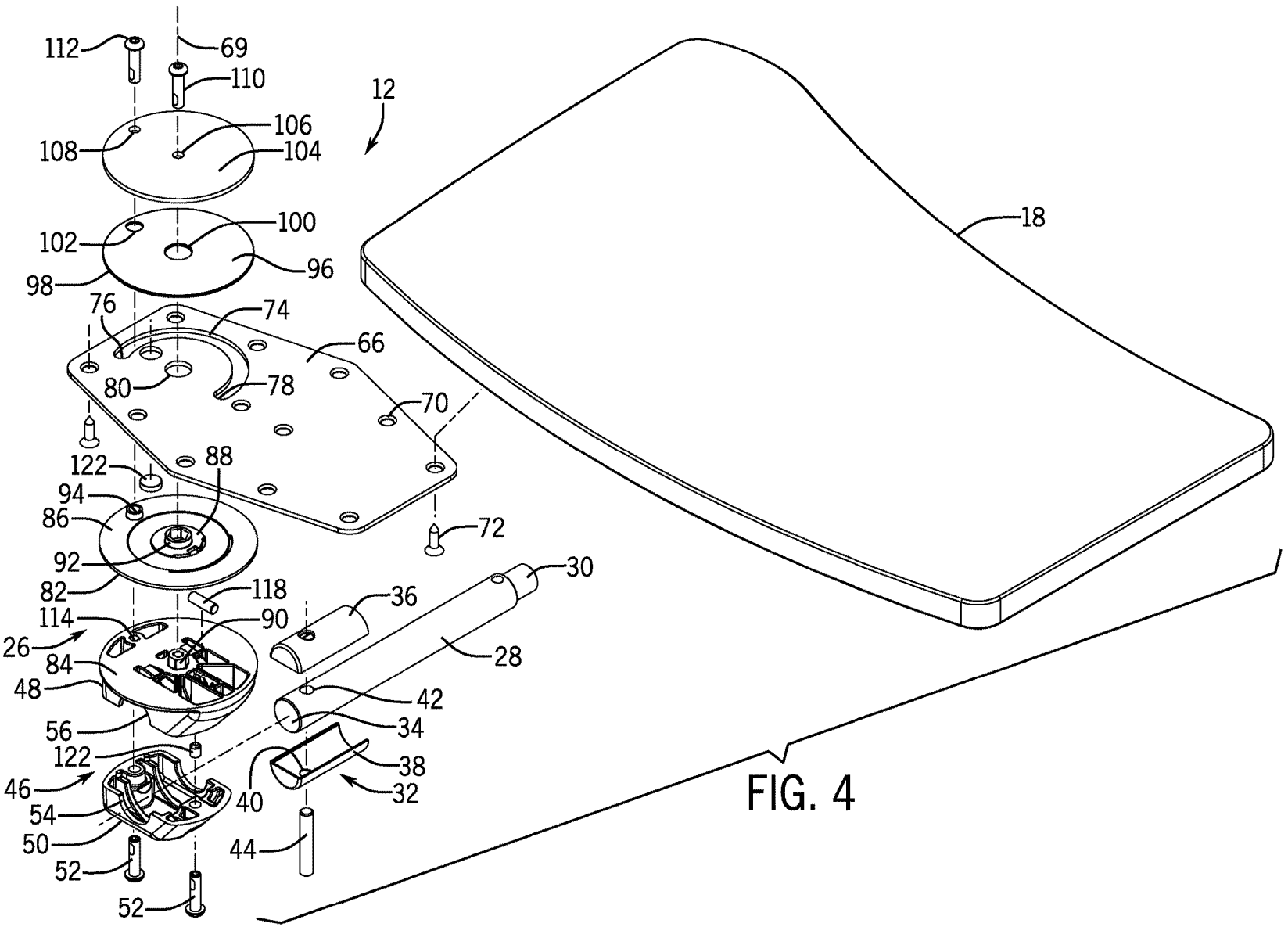
FIG. 4 is an exploded, magnified view of the components of the tablet mounting assembly.

FIG. 4 is a magnified, exploded view of the tablet arm assembly 12 of the present disclosure. The tablet arm assembly 12 generally includes the tablet 18 and a mounting assembly 26. The mounting assembly 26 includes a pivot bar 28 that defines the first pivot axis and includes an attachment end 30 designed to allow the pivot bar 28 to be securely attached to the arm rest 16 and arm 14 of the chair, as best shown in FIG. 1. The pivot bar 28 provides the point of attachment for the rotational movement of the tablet 18 and allows the mounting assembly 26 to be attached to a variety of different chair types. The pivot bar 28 provides a common point of attachment for the tablet 18.

The pivot bar 28 includes an end cap 32 mounted to the outer end 34 of the pivot bar 28. In the embodiment shown, the end cap 32 includes an upper half 36 and a lower half 38 that combine to surround the outer end 34 of the pivot bar 28. In the embodiment illustrated, the end cap 32 is formed from two molded plastic halves that are joined to each other to surround the outer end 34.

Figure 13:
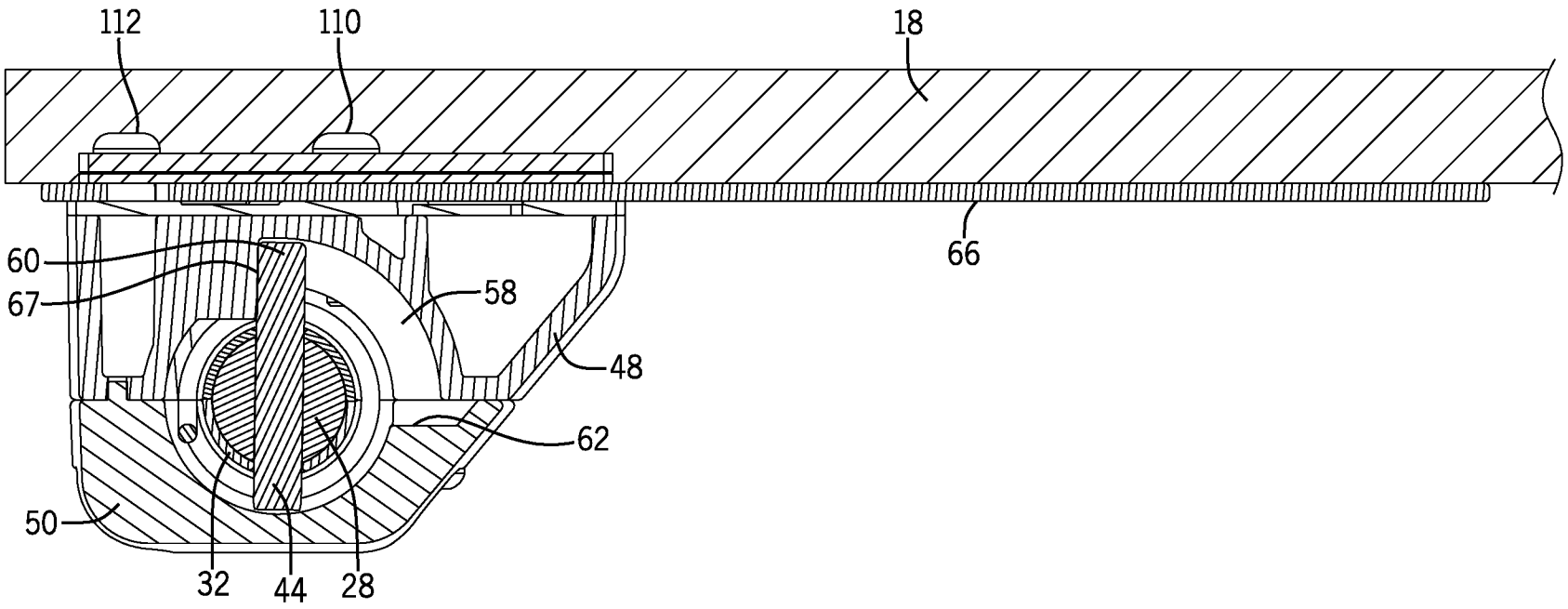
FIG. 13 is a section view showing the tablet in the use position.

Both halves of the end cap 32 include an access hole 40 that are generally aligned with a similar access hole 42 that extends through the pivot bar 28. The access holes 40, 42 are each sized to receive a pivot limiting pin 44. The pivot limiting pin 44 is a metal pin that is inserted into the outer end 34 of the pivot bar 28. As best shown in FIG. 13, the pivot limiting pin 44 has a length that is greater than the outer diameter of the pivot bar 28 and the associated end cap 32. In this manner, the two ends of the pivot limiting pin 44 extend past the outer diameter of the pivot bar 28 and act to limit the pivoting movement of the tablet 18 in a manner to be described in greater detail below.

Referring back to FIG. 4, the pivot bar 28 provides a point of attachment for an outer housing 46. The outer housing 46 is formed from a first casting 48 and a second casting 50 that are joined to each other. The first and second castings 48, 50 are each formed as an aluminum casting and provide the required support and mounting locations as will be described. The first and second castings 48, 50 are joined to each other by a pair of connectors 52 that extend through aligned holes in the first and second castings 48, 50. The connectors 52 are used to attach the first and second castings once the first and second castings have been positioned to surround the end cap 32 at the outer end 34 of the pivot bar 28.

As shown in FIG. 4, the second casting 50 includes a curved mounting slot 54 while the first casting 48 includes a similar mounting slot 56. The first and second castings 48, 50 are designed such that the end cap 32 mounted to the pivot bar 28 is entrapped between the first casting 48 and the second casting 50. The combination of the first and second castings 48, 50, which form the outer housing 46, is rotatable around the end cap 32 while the pivot limiting pin 44 provides positive stops for this pivoting movement.

Figure 5:
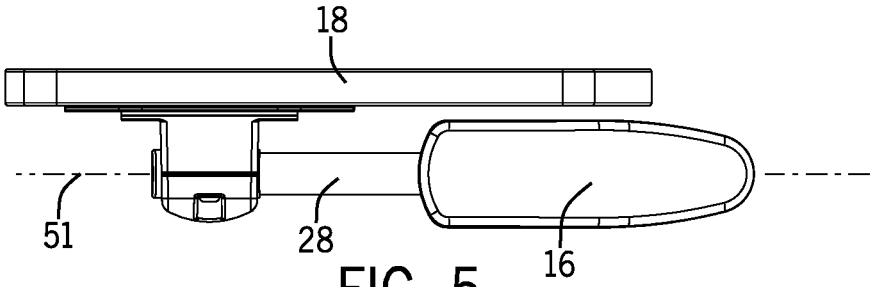
FIG. 5 is a top view of the chair arm and tablet in the storage position.
Figure 6:
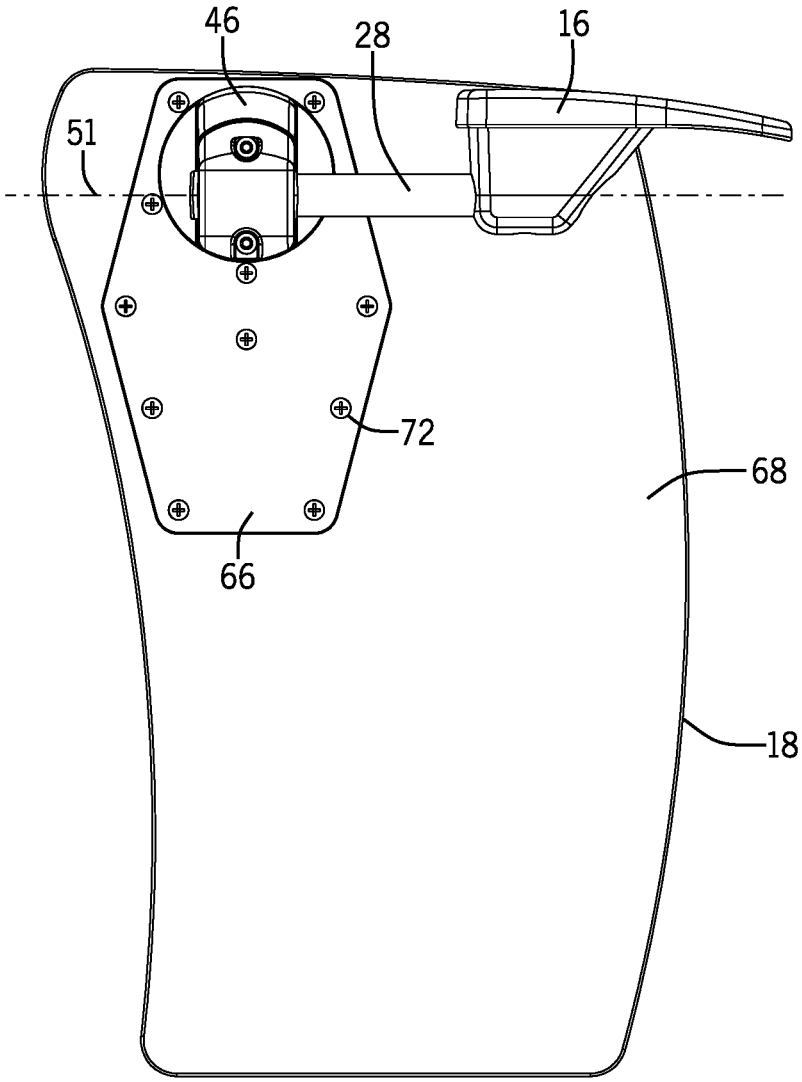
FIG. 6 is a side view of the chair arm and tablet in the storage position.
Figure 12:
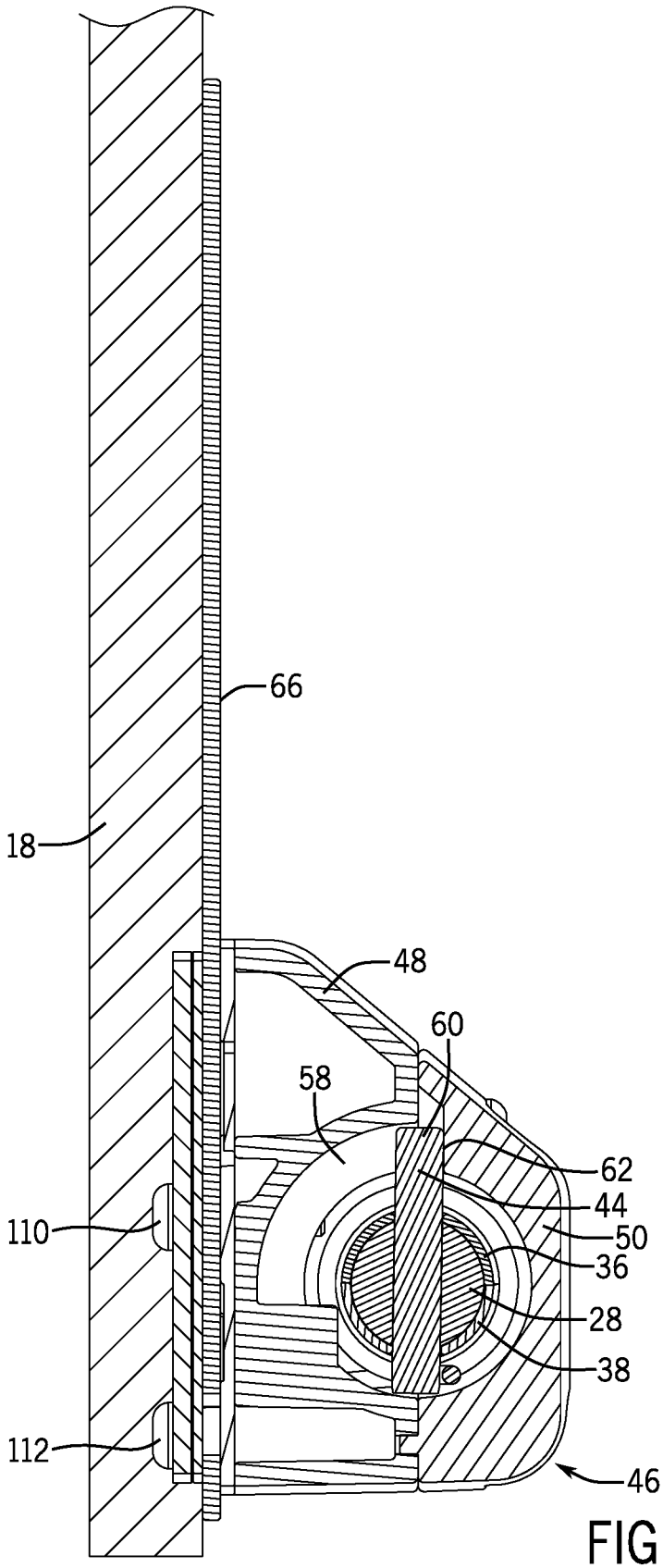
FIG. 12 is a section view illustrating the tablet arm in the intermediate position.

As best shown in FIGS. 12 and 13, the first casting 48 includes a movement channel 58 that allows the outer end 60 of the pivot limiting pin 44 to move therein. As can be understood in the drawing figures, the pivot limiting pin 44 is stationary and extends through the pivot bar 28. The combination of the first casting 48 and second casting 50 allow the entire outer housing 46 to pivot about a first pivot axis 51 that extends through the pivot bar 28, as shown in FIGS. 5 and 6. The first pivot axis 51 allows for movement of the tablet between the upright vertical position shown in FIG. 12 and the horizontal, usage position shown in FIG. 13.

In the upright position shown in FIG. 12, the outer end 60 of the pivot limiting pin 44 contacts a stop shoulder 62 formed as part of the second housing 50. In the horizontal, usage position shown in FIG. 13, the outer end 60 contacts a stop shoulder 64 formed as part of the first housing 48. In this manner, the stop shoulders 62 and 64 define the approximate 90° of motion for the tablet 18 from the upright position shown in FIG. 12 to the horizontal position shown in FIG. 13. As can be understood in FIGS. 12 and 13, the two stop shoulders 62, 64 are each contained within the outer housing, which thus conceals any pinch points that may exist between the outer end 60 of the pivot limiting pin 44 and the stop shoulders.

Referring back to FIG. 4, the mounting assembly 26 includes a mounting plate 66 which is used to secure the entire mounting assembly to a back face 68 of the tablet 18 as best shown in FIG. 6. The mounting plate 66 is a steel plate that includes a series of attachment holes 70 that each receive a screw 72. The screws 72 securely attach the mounting plate 66 to the back face 68 of the tablet 18.

As illustrated in FIG. 4, the mounting plate 66 includes a guide track 74. The guide track 74 is an arcuate removed portion of the mounting plate 66 that is centered on a second pivot axis 69. The guide track 74 extends from a first end 76 to a second end 78. In the embodiment shown, the guide track extends over approximately 210° relative to the second pivot axis 69 between the first end 76 and the second end 78. In addition to the guide track 74, the mounting plate 66 includes an opening 80.

The mounting assembly 26 further includes a lower bearing 82 that is positioned between a top face 84 of the first casting 48 and the mounting plate 66. The lower bearing 82 is formed from a plastic material and is sandwiched between the metal mounting plate 66 and the aluminum first casting 48. The plastic lower bearing 82 thus prevents metal-on-metal contact during use of the tablet arm assembly.

The lower bushing 82 has a circular outer edge 86 having a diameter approximately equal to the diameter of the top face 84 of the first casting 48. The lower bearing 82 includes a center hub 88 that receives a center hub 90 that extends from the top face 84 of the first casting 48. The center hub 90 has a hexagonal outer surface that is received within a corresponding hexagonal inner cavity 92 formed within the center hub 88. The hexagonal surfaces allow the center hub 90 to engage the center hub 88 and to prevent rotation therebetween.

The lower bearing 82 further includes a guide hub 94 that is sized to be received within the guide track 74. The guide hub 94 is designed to move within the guide track 74 in a manner to be described in greater detail below.

The mounting assembly 26 further includes an upper bearing 96 that is formed from a similar plastic material as used to form the lower bearing 82. The upper bearing 96 has a corresponding outer diameter defined by an edge surface 98. The upper bearing 96 further includes a center opening 100 that is sized to receive the center hub 88 formed on the lower bearing 82. The center opening 100 is generally aligned with the opening 80 formed in the mounting plate 66. The upper bearing 96 further includes an outer opening 102 formed near the edge surface 98. The outer opening 102 is sized to receive the guide hub 94 formed on the lower bearing 82. In this manner, the guide track 74 of the mounting plate 66 is sandwiched between the lower bearing 82 and the upper bearing 96 and the guide hub 94 is retained within the guide track 74.

The mounting assembly 26 further includes a clamp plate 104 that is formed from a metallic material. The clamp plate 104 includes a center opening 106 and an outer opening 108. Since the clamp plate 104 is formed from a metallic material, the plastic material of the upper bearing 96 prevents metal-to-metal contact between the clamp plate 104 and the mounting plate 66.

As can be seen in FIG. 4, a center pivot pin 110 defines the second pivot axis 69 and extends through the center opening 106 of the clamp plate 104, the center opening 100 of the upper bearing 96, the opening 80 of the mounting plate 66, the center hub 88 of the lower bearing 82 and is ultimately received within the center hub 90 of the first casting 48. The pivot pin 110 defines the second pivot axis 69 and allows the mounting plate 66 and the attached tablet 18 to rotate about the second pivot axis 69 relative to the outer housing 46. The pivoting movement of the tablet 18 about the second pivot axis 69 is limited by the configuration of the guide track 74. Specifically, a guide pin 112 extends through the clamp plate 104, the upper bearing 96 and the guide hub 94 of the lower bearing 82 until the guide pin 112 is retained by a pin opening 114 formed in the first casting 48. The guide pin 112 extends through the guide hub 94 formed on the lower bearing 82. As the tablet 18 and mounting plate 66 rotate, the guide hub 94 travels within the path defined by the guide track 74 between the first end 76 and the second end 78.

Figure 11:
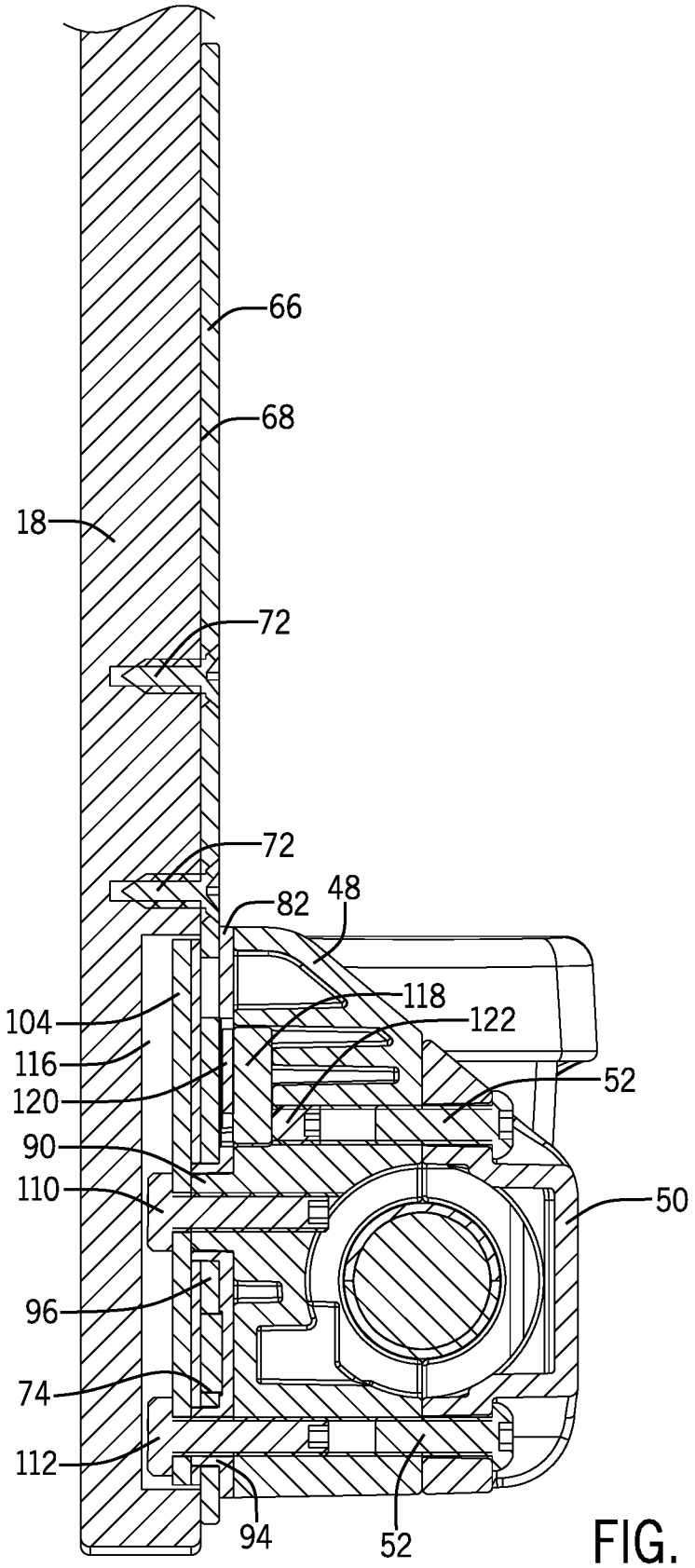
FIG. 11 is a section view taken along line 11-11 of FIG. 8.

Referring now to FIG. 11, the tablet 18 includes a cavity 116 that is recessed from the back face 68. The cavity 116 receives the clamp plate 104 and the upper bearing 96. As illustrated in FIG. 11, the pivot pin 110 extends into the center hub 90 formed in the first casting 48. Likewise, the guide pin 112 extends through the guide hub 94 formed in the lower bearing 82 and is also received within the first casting 48. The guide hub 94 travels within the guide track 74 as illustrated.

As can be understood in FIGS. 4 and 11, a friction adjustment pin 118 is received within the first casting 48. The adjustment pin 118 is positioned between a friction disc 120 and an adjustable set screw 122. As can be understood in FIG. 11, when the set screw 122 is adjusted, the adjustment pin 118 is moved toward or away from the mounting plate 66. As the pin 118 is moved toward the mounting plate 66, the friction disc 120 creates greater friction between the mounting plate 66 and the outer housing. When the set screw 122 is rotated in the opposite direction, the amount of friction between the friction disc 120 and the mounting plate 66 is reduced. In this manner, the set screw 122 can be used to adjust the amount of friction created between the moving mounting plate 66 and the stationary outer housing 46.

Figure 7:
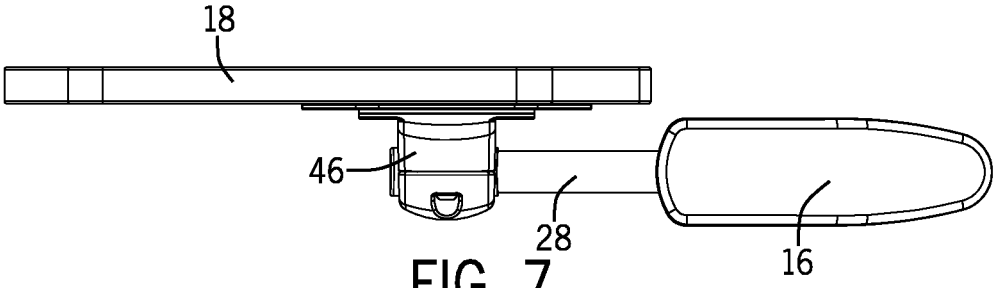
FIG. 7 is a top view of the chair arm and tablet in the intermediate position.

FIGS. 5 and 6 illustrate the tablet 18 in its vertical, storage position. In this position, the mounting plate 66 is generally vertical relative to the generally horizontal pivot bar 28. In this location, the guide hub 94 of the lower bearing 82 shown in FIG. 4 is generally in contact with the first end 76 of the guide track 74. As described previously, the outer housing 46 conceals the guide track 74 and guide hub 94 to prevent any pinching during subsequent movement. When a user desires to use the tablet 18, the user first rotates the tablet about the second pivot axis to the vertical, intermediate position shown in FIGS. 2 and 7-8. During this pivoting movement shown by arrow 22, the pivoting movement of the tablet 18 causes the hub 94 to travel within the guide track 74 until the hub reaches the second end 78. The second end 78 defines the vertical position shown in both FIGS. 2 and 8. As the tablet moves as described, the friction disc 120 shown in FIG. 11 creates additional friction as determined by the location of the set screw 122. This additional friction helps to prevent a hard stop when the tablet reaches the position shown in FIGS. 2 and 8.

Figure 8:
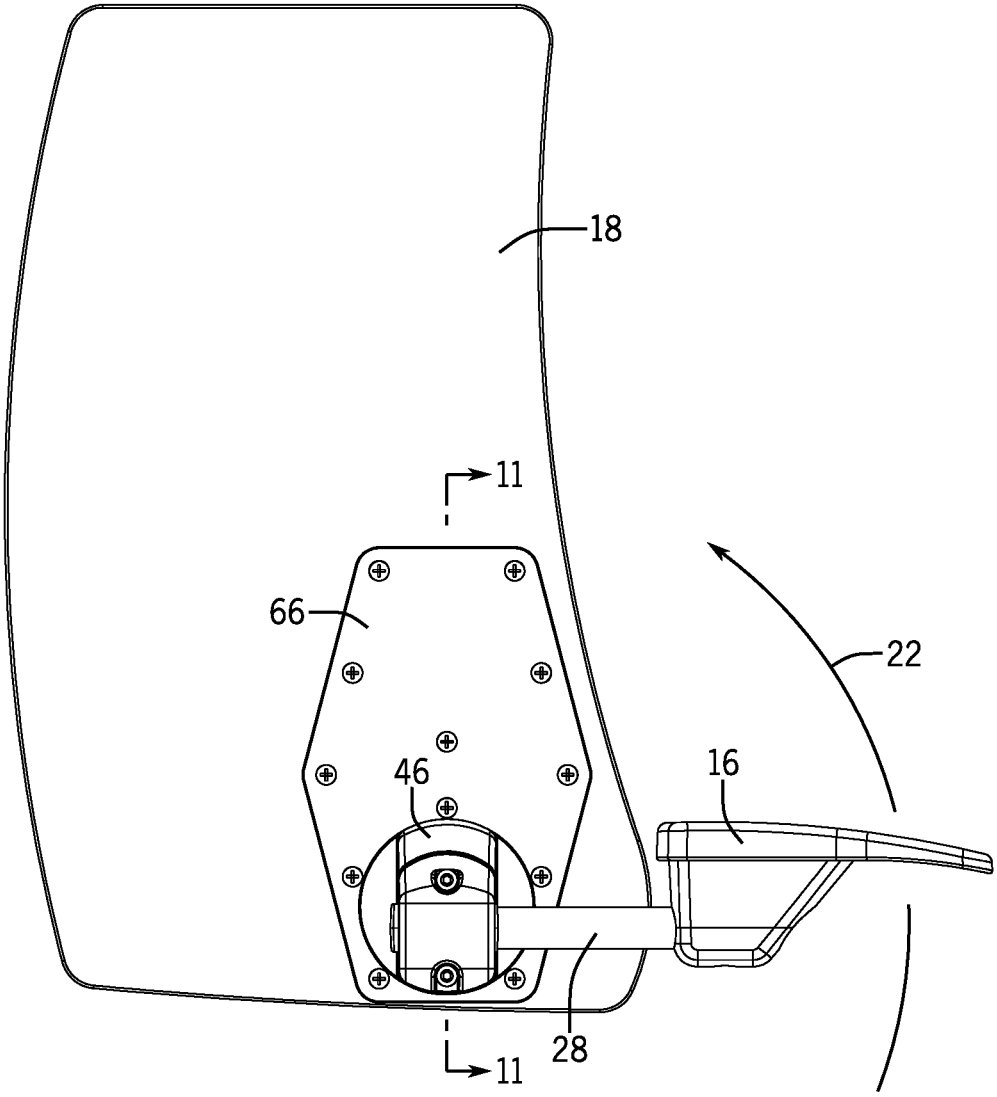
FIG. 8 is a side view of the chair arm and tablet in the intermediate position.

Once in the position shown in FIG. 8, the user can then rotate the tablet about the first pivot axis 51 into its usage position shown in FIGS. 3 and 9-10. As the tablet moves from the vertical position shown in FIG. 2 to the horizontal position shown in FIG. 3, the pivot limiting pin 44 moves from contact with the stop shoulder 62 shown in FIG. 12 to the stop shoulder 67 shown in FIG. 13. As was discussed previously, the outer end 60 of the pivot limiting pin 44 moves within the movement channel 58. The stop shoulder 67 thus defines the horizontal, usage position as is best illustrated in FIG. 13. The pivoting movement from the vertical position to the horizontal position, as shown by arrow 124, thus allows the user to place the tablet across the lap of the user, as best shown in both FIGS. 3 and 9.

As can be understood by the above description, the outer housing 46 prevents against possible pinching of fingers during the two types of movement of the tablet 18. Since both the guide track 74 and the movement channel 58 which control the pivoting movement of the tablet are concealed within the outer housing 46, the outer housing 46 thus prevents any pinching during movement.

Figure 14:
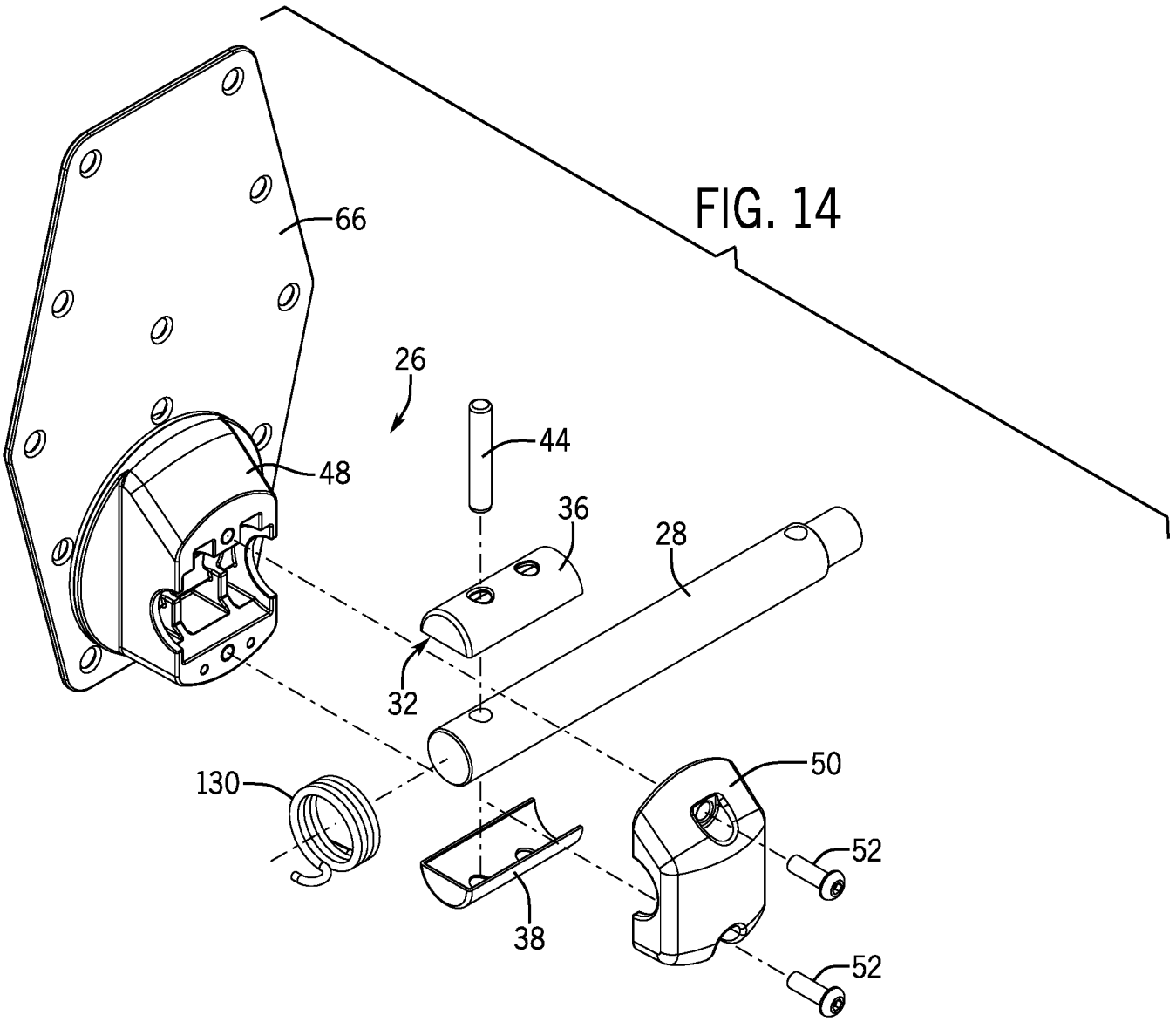
FIG. 14 is an alternate embodiment of the mounting assembly for the tablet arm.

FIG. 14 illustrates a second embodiment of the mounting assembly 26 of the present disclosure. The mounting assembly 26 shown in FIG. 14 includes many of the same components, including the pivot bar 28, the upper and lower halves 36 and 38 of the end cap 32 and the first and second castings 48, 50. In the embodiment shown in FIG. 14, a torsion spring 130 is positioned to surround the end cap 32 within the first casting 48 and second casting 50 when the first and second castings are connected to each other by the connectors 52. The torsion spring 130 provides a bias force to urge the tablet into the vertical, intermediate position shown in FIG. 2. When the tablet is moved to the horizontal position shown in FIG. 3, the movement is against the bias force created by the bias spring 130. In this manner, the torsion bias spring 130 urges the tablet into the upright, vertical position in FIG. 2. Although the torsion bias spring 130 is shown in one embodiment, it is contemplated that the torsion bias spring 130 could be eliminated.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A tablet assembly for use at a side of a chair, comprising:

a tablet including an outer peripheral edge and being rotatable about a first pivot axis and a second pivot axis;

a horizontal pivot bar configured to be securely mounted to the chair, wherein the pivot bar defines a first pivot axis;

a pivot limiting pin extending through the pivot bar;

an outer housing surrounding the pivot bar and the pivot limiting pin, the outer housing including a center hub located along the second pivot axis and first and second stop shoulders that engage the pivot limiting pin to limit rotation of the tablet about the first pivot axis;

a mounting plate attached to a bottom face of the tablet, the mounting plate including an arcuate guide track centered along the second pivot axis and located within the outer peripheral edge of the tablet and extending between a first stop and a second stop, wherein the second pivot axis is perpendicular to the arcuate guide track; and a lower bearing positioned between the mounting plate and the outer housing and including a guide hub extending into the guide track for movement within the guide track.

2. The tablet assembly of claim 1 wherein the outer housing includes a first casting and a second casting joined to each other and entrapping the pivot bar there between.

3. The tablet assembly of claim 1 wherein the first casting includes both the first and second stop shoulders.

4. The tablet assembly of claim 1 further comprising an upper bearing positioned on an opposite side of the mounting plate from the lower bearing, the second bearing receiving the guide hub.

5. The tablet assembly of claim 1 wherein the tablet and mounting plate rotate about the center hub.

6. The tablet assembly of claim 5 wherein the lower bearing is centered along the center hub.

7. The tablet assembly of claim 1 further comprising a pivot bushing surrounding an outer end of the pivot bar, wherein the outer housing rotates about the pivot bushing.

8. The tablet assembly of claim 7 wherein the pivot bushing is formed from a plastic material.

9. A tablet assembly for use at a side of a chair, comprising:

a tablet being rotatable about a first pivot axis and a second pivot axis;

a horizontal pivot bar configured to be securely mounted to the chair, wherein the pivot bar defines a first pivot axis;

a pivot limiting pin extending through the pivot bar;

an outer housing surrounding the pivot bar and the pivot limiting pin, the outer housing including first and second stop shoulders that engage the pivot limiting pin to limit rotation of the tablet about the first pivot axis;

a mounting plate attached to a bottom face of the tablet, the mounting plate including an arcuate guide track extending between a first stop and a second stop, wherein the second pivot axis is perpendicular to the arcuate guide track;

a lower bearing positioned between the mounting plate and the outer housing and including a guide hub extending into the guide track for movement within the guide track; and a friction disk positioned between the outer housing and mounting plate, wherein the friction disk is adjustable to increase the friction during movement of the mounting plate.

10. A chair, comprising:

a seat, at least one chair arm;

a tablet including an outer peripheral edge and being rotatable about a first pivot axis and a second pivot axis;

a horizontal pivot bar configured to be securely mounted to the chair arm, wherein the pivot bar defines a first pivot axis;

a pivot limiting pin extending through the pivot bar;

an outer housing surrounding the pivot bar and the pivot limiting pin, the outer housing including a center hub located along the second pivot axis and first and second stop shoulders that engage the pivot limiting pin to limit rotation of the tablet about the first pivot axis;

a mounting plate attached to a bottom face of the tablet, the mounting plate including an arcuate guide track centered along the second pivot axis and located within the outer peripheral edge of the tablet and extending between a first stop and a second stop, wherein the second pivot axis is perpendicular to the arcuate guide track; and a lower bearing positioned between the mounting plate and the outer housing and including a guide hub extending into the guide track for movement within the guide track.

11. The tablet assembly of claim 10 wherein the outer housing includes a first casting and a second casting joined to each other and entrapping the pivot bar there between.

12. The tablet assembly of claim 10 wherein the first casting includes both the first and second stop shoulders.

13. The tablet assembly of claim 10 further comprising an upper bearing positioned on an opposite side of the mounting plate from the lower bearing, the second bearing receiving the guide hub.

14. The tablet assembly of claim 10 wherein the tablet and mounting plate rotate about the center hub.

15. The tablet assembly of claim 14 wherein the lower bearing is centered along the center hub.

16. The tablet assembly of claim 10 further comprising a friction disk positioned between the outer housing and mounting plate, wherein the friction disk is adjustable to increase the friction during movement of the mounting plate.

17. The tablet assembly of claim 10 further comprising a pivot bushing surrounding an outer end of the pivot bar, wherein the outer housing rotates about the pivot bushing.

18. The tablet assembly of claim 17 wherein the pivot bushing is formed from a plastic material.

* * * * *